US007906465B2

(12) United States Patent
Devlin et al.

(10) Patent No.: US 7,906,465 B2
(45) **Date of Patent: *Mar. 15, 2011**

(54) LUBRICANT COMPOSITIONS

(75) Inventors: Mark T. Devlin, Richmond, VA (US); Tze-chi Jao, Glen Allen, VA (US)

(73) Assignee: Afton Chemical Corp., Richmond, VA (US)

( * ) Notice: Subject to any disclaimer, the term of this patent is extended or adjusted under 35 U.S.C. 154(b) by 441 days.

This patent is subject to a terminal disclaimer.

(21) Appl. No.: 11/457,596

(22) Filed: Jul. 14, 2006

(65) Prior Publication Data

US 2008/0015130 A1 Jan. 17, 2008

(51) Int. Cl.
*C10M 169/00* (2006.01)
*C10L 1/22* (2006.01)
*C10G 71/00* (2006.01)

(52) U.S. Cl. ..... 508/136; 508/192; 208/19

(58) Field of Classification Search ..... 508/136, 508/545, 192, 185; 208/19

See application file for complete search history.

(56) References Cited

U.S. PATENT DOCUMENTS

| | | | | |
|---|---|---|---|---|
| 2,001,108 | A | 5/1935 | Lorand | |
| 2,081,075 | A | 5/1937 | Vobach | |
| 2,095,538 | A | 10/1937 | Vobach | |
| 2,144,078 | A | 1/1939 | Neely | |
| 2,163,622 | A | 6/1939 | Neely et al. | |
| 2,270,183 | A | 1/1942 | Cook et al. | |
| 2,292,205 | A | 8/1942 | Denison et al. | |
| 2,335,017 | A | 11/1943 | McNab et al. | |
| 2,399,877 | A | 5/1946 | McNab et al. | |
| 2,416,281 | A | 2/1947 | Berger et al. | |
| 2,451,345 | A | 10/1948 | McNab et al. | |
| 2,451,346 | A | 10/1948 | McNab et al. | |
| 2,485,861 | A | 10/1949 | Campbell et al. | |
| 2,501,731 | A | 3/1950 | Mertes | |
| 2,501,732 | A | 3/1950 | Mertes | |
| 2,585,520 | A | 2/1952 | Van Ess et al. | |
| 2,616,904 | A | 11/1952 | Asseff et al. | |
| 2,616,905 | A | 11/1952 | Asseff et al. | |
| 2,616,906 | A | 11/1952 | Asseff et al. | |
| 2,616,911 | A | 11/1952 | Asseff et al. | |
| 2,616,924 | A | 11/1952 | Asseff et al. | |
| 2,616,925 | A | 11/1952 | Asseff et al. | |
| 2,617,049 | A | 11/1952 | Asseff et al. | |
| 2,671,758 | A | 3/1954 | Vinograd et al. | |
| 2,695,910 | A | 11/1954 | Asseff et al. | |
| 3,127,351 | A | 3/1964 | Brown et al. | |
| 3,178,368 | A | 4/1965 | Hanneman | |
| 3,367,867 | A | 2/1968 | Abbott et al. | |
| 3,480,548 | A | 11/1969 | Hellmuth et al. | |
| 3,496,105 | A | 2/1970 | Le Suer | |
| 3,629,109 | A | 12/1971 | Gergel et al. | |
| 3,679,584 | A | 7/1972 | Hellmuth | |
| 3,829,381 | A | 8/1974 | Le Suer | |
| 3,865,737 | A | 2/1975 | Kemp | |
| 3,907,691 | A | 9/1975 | King et al. | |
| 3,909,691 | A | 9/1975 | Wilson et al. | |
| 4,100,085 | A | 7/1978 | Peditto et al. | |
| 4,129,589 | A | 12/1978 | Eliades et al. | |
| 4,137,184 | A | 1/1979 | Bakker | |
| 4,184,740 | A | 1/1980 | d'Auria et al. | |
| 4,212,752 | A | 7/1980 | Peditto et al. | |
| 4,617,135 | A | 10/1986 | Muir | |
| 4,647,387 | A | 3/1987 | Muir | |
| 4,880,550 | A | 11/1989 | Hunt | |
| 4,965,003 | A | 10/1990 | Schlicht | |
| 4,965,004 | A | 10/1990 | Schlicht et al. | |
| 5,230,834 | A | 7/1993 | Gutierrez et al. | |
| 5,282,991 | A | 2/1994 | Malcolm et al. | |
| 5,891,786 | A | 4/1999 | Srinivasan et al. | |
| 6,451,745 | B1 * | 9/2002 | Ward | 508/192 |
| 2002/0072478 | A1 | 6/2002 | Ishida et al. | |
| 2004/0167041 | A1 * | 8/2004 | Arimoto | 508/272 |
| 2005/0043191 | A1 | 2/2005 | Farng et al. | |
| 2005/0101494 | A1 | 5/2005 | Iyer et al. | |
| 2005/0133407 | A1 | 6/2005 | Abernathy et al. | |
| 2005/0137096 | A1 | 6/2005 | Yoon et al. | |
| 2005/0261145 | A1 * | 11/2005 | Rosenbaum et al. | 508/466 |
| 2006/0094607 | A1 | 5/2006 | Devlin et al. | |
| 2006/0264340 | A1 | 11/2006 | Iyer et al. | |
| 2006/0293193 | A1 | 12/2006 | Rosenbaum et al. | |
| 2008/0051304 | A1 * | 2/2008 | Devlin et al. | 508/185 |
| 2008/0531305 | | 2/2008 | Devlin et al. | |

FOREIGN PATENT DOCUMENTS

| | | | |
|---|---|---|---|
| CA | 1 120 461 | | 3/1982 |
| CA | 2487767 | A1 | 5/2005 |
| CN | 1218096 | A | 6/1999 |
| DE | 68923716 | T2 | 3/1996 |
| EP | 0330523 | | 8/1989 |
| EP | 1518919 | A1 | 3/2005 |
| EP | 1518921 | A1 | 3/2005 |
| EP | 1 657 293 | | 5/2006 |
| EP | 1661971 | A1 | 5/2006 |
| EP | 1 688 476 | | 8/2006 |
| EP | 1724330 | A1 | 11/2006 |

(Continued)

OTHER PUBLICATIONS

Klamann, Dieter: Schmierstoffe und verwandte Produkte. Weinheim, Verlag Chemie, 1982, S. 81-101. ISBN.

(Continued)

*Primary Examiner* — Walter D Griffin
*Assistant Examiner* — Frank C Campanell
(74) *Attorney, Agent, or Firm* — Luedeka, Neely & Graham, P.C.

(57) ABSTRACT

A lubricant composition comprising a detergent and a base oil comprising less than about 3% by weight of tetracycloparaffins is disclosed. Methods of making and using the composition are also disclosed.

20 Claims, No Drawings

FOREIGN PATENT DOCUMENTS

| | | | |
|---|---|---|---|
| EP | 1785476 | A1 | 5/2007 |
| EP | 1900797 | A1 | 3/2008 |
| GB | 530491 | A | 12/1940 |
| GB | 909243 | A | 10/1962 |
| GB | 911491 | A | 11/1962 |
| GB | 2 409 462 | | 6/2005 |
| GB | 2 416 775 | | 2/2006 |
| RU | 2009176 | C1 | 3/1994 |
| RU | 2129141 | C1 | 4/1999 |
| RU | 2276683 | C1 | 5/2006 |
| WO | 97/44413 | A1 | 11/1997 |
| WO | WO 02/064710 | | 8/2002 |
| WO | 03/064568 | A3 | 8/2003 |
| WO | 2005/066314 | A1 | 7/2005 |
| WO | 2005/087901 | A2 | 9/2005 |
| WO | WO 2005/113734 | | 12/2005 |
| WO | WO 2006/099057 | | 9/2006 |
| WO | WO 2007/075831 | | 7/2007 |

OTHER PUBLICATIONS

German Office Action dated Sep. 4, 2008, from corresponding German patent application.

M.T. Devlin, et al., "Effect of Detailed Base Oil Structure on Oxidation Performance of Automatic Transmission Fluids," Proceedings of WTC 2005, Sep. 12-16, 2005, pp. 1-2.

Analytical Chemistry, 64:2227 (1992).

M. T. Devlin, T. Hammock, and T.-C. Jao, "Effect of Mechanical Shear on the Thin Film Properties of Base Oil-Polymer Mixtures", Lubrication Science vol. 14 (2), 2002.

D. Dawson, et al., "Lubrication at the Frontier: The Role of The Interface and Surface Layers in the Thin Film and Boundary Regime," Elsevier Science B.V., 1999, p. 769-766.

R.C. Castle, et al., "The Behavior of Friction Modifiers Under Boundary and Mixed EHD Conditions," SAE 961142, pp. 1-4, publish date May 2003.

Liza Taylor, et al. "Film-Forming Properties of Zinc-Based and Ashless Antiwear Additives," International Spring Fuels & Lubricants, Paris, France, Jun. 19-22, 2000, pp. 1-11.

M.T. Devlin, et al. "Improved Understanding of Axle Oil Rheology Effects on Torque Transfer Efficiency and Axle Oil Operating Temperature," SAE 2003-01-1972, 2003, pp. 1-10.

* cited by examiner

LUBRICANT COMPOSITIONS

DESCRIPTION OF THE DISCLOSURE

1. Field of the Disclosure

The present disclosure relates to lubricating composition comprising a detergent and a base oil comprising less than about 3% by weight of tetracycloparaffins.

2. Background of the Disclosure

In recent years there has been growing concern to produce energy-efficient lubricated components. Moreover, modern engine oil specifications require lubricants to demonstrate fuel efficiency in standardized engine tests. The thickness and frictional characteristics of thin lubricant films are known to affect the fuel economy properties of oils.

Thin-film friction is the friction generated from fluid, such as a lubricant, pushing between two surfaces, wherein the distance between the two surfaces is very narrow. It is known that different additives normally present in a lubricant composition form films of different thicknesses, which can have an effect on thin-film friction. Moreover, some additives have a narrow range of conditions wherein they provide reduced friction properties to a lubricant composition. Further, some additives, such as zinc dialkyl dithiophosphate (ZDDP) are known to increase thin-film friction.

However, it is also known that some additives are very expensive. And, the use of additional amounts of an additive to a lubricant composition to reduce thin-film friction can be quite costly to the manufacturer.

A major component of a lubricant composition can be the base oil, which is relatively inexpensive. Base oils are known and have been categorized under Groups I-V. The base oils are placed in a given Group based upon their % saturates, % sulfur content, and viscosity index, For example, all Group II base oils have greater than 90% saturates, less than 0.03% sulfur, and a viscosity index ranging from ≧80 to ≦120. However, the proportions of aromatics, paraffinics, and naphthenics can vary substantially in the Group II base oils. It is known that the difference in these proportions can affect the properties of a lubricant composition, such as oxidative stability.

What is needed is a lubricant composition that is inexpensive and can provide at least one of reduced thin-film friction and increased fuel economy.

SUMMARY OF THE DISCLOSURE

In accordance with the disclosure, there is disclosed a lubricant composition comprising a detergent and a base oil comprising less than about 3% by weight of tetracycloparaffins.

There is also disclosed a method of reducing thin-film friction of a fluid between surfaces comprising providing to the fluid a composition comprising a detergent and a base oil comprising less than about 3% by weight of tetracycloparaffins.

In an aspect, there is disclosed a method of increasing fuel efficiency in a vehicle comprising providing to a vehicle a composition comprising a detergent and a base oil comprising less than about 3% by weight of tetracycloparaffins.

There is further disclosed a method of making a lubricant composition comprising combining a detergent and a base oil comprising less than about 3% by weight of tetracycloparaffins.

Additional objects and advantages of the disclosure will be set forth in part in the description which follows, and can be learned by practice of the disclosure. The objects and advantages of the disclosure will be realized and attained by means of the elements and combinations particularly pointed out in the appended claims.

It is to be understood that both the foregoing general description and the following detailed description are exemplary and explanatory only and are not restrictive of the disclosure, as claimed.

DESCRIPTION OF THE EMBODIMENTS

The lubricating composition of the present disclosure can comprise a detergent and a base oil comprising less than about 3% by weight of tetracycloparaffins. The base oil can be any base oil categorized in Groups I-V. In an aspect, the base oil is a Group II base oil. The base oil can comprise less than about 3% by weight, for example less than about 2% by weight, and as a further example less than about 1% by weight of tetracycloparaffins relative to the total weight of the base oil.

The disclosed base oils can have a lower thin-film friction coefficient as compared to base oils not comprising less than 3% by weight of tetracycloparaffins. Moreover, it is believed, without being limited to any particular theory, that when the concentration of base oil structures is reduced the effect of individual additives on thin-film friction is altered. In an aspect, the combination of certain additives with the disclosed base oil can have a synergistic effect.

The base oil can be present in the lubricating composition in any desired or effective amount. For example, the base oil can be present in a major amount. A "major amount" is understood to mean greater than or equal to 50% by weight relative to the total weight of the composition. As a further example, the base oil can be present in an amount greater than or equal to 80%, and as an additional example, greater than or equal to 90% by weight relative to the total weight of the composition.

In an aspect, the detergent for use in the disclosed lubricating composition can be a metallic detergent. A suitable metallic detergent can include an oil-soluble neutral or overbased salt of alkali or alkaline earth metal with one or more of the following acidic substances (or mixtures thereof: (1) a sulfonic acid, (2) a carboxylic acid, (3) a salicylic acid, (4) an alkyl phenol, (5) a sulfurized alkyl phenol, and (6) an organic phosphorus acid characterized by at least one direct carbon-to-phosphorus linkage. Such an organic phosphorus acid can include those prepared by the treatment of an olefin polymer (e.g., polyisobutylene having a molecular weight of about 1,000) with a phosphorizing agent such as phosphorus trichloride, phosphorus heptasulfide, phosphorus pentasulfide, phosphorus trichioride and sulfur, white phosphorus and a sulfur halide, or phosphorothioic chloride.

The term "overbased" in connection with metallic detergents is used to designate metal salts wherein the metal is present in stoichiometrically larger amounts than the organic radical. The commonly employed methods for preparing the overbased salts involve heating a mineral oil solution of an acid with a stoichiometric excess of a metal neutralizing agent such as the metal oxide, hydroxide, carbonate, bicarbonate, or sulfide at a temperature of about 50° C., and filtering the resultant product. The use of a "promoter" in the neutralization step to aid the incorporation of a large excess of metal likewise is known. Examples of compounds useful as the promoter include phenolic substances such as phenol, naphthol, alkyl phenol, thiophenol, sulfurized alkyiphenol, and condensation products of formaldehyde with a phenolic substance; alcohols such as methanol,2-propanol, octanol, CELLOSOLVE® alcohol, CARBITOL® alcohol, ethylene glycol, stearyl alcohol, and cyclohexyl alcohol; and amines such as aniline, phenylene diamine, phenothiazine, phenyl-beta-naphthylamine, and dodecylamine. A particularly effective method for preparing the basic salts comprises mixing an acid with an excess of a basic alkaline earth metal neutralizing agent and at least one alcohol promoter, and carbonating the mixture at an elevated temperature such as 60° C. to 200° C.

Examples of suitable metal-containing detergents include, but are not limited to, neutral and overbased salts of such substances as neutral sodium sulfonate, an overbased sodium sulfonate, a sodium carboxylate, a sodium salicylate, a sodium phenate, a sulfurized sodium phenate, a lithium sulfonate, a lithium carboxylate, a lithium salicylate, a lithium phenate, a sulfurized lithium phenate, a calcium sulfonate, a calcium carboxylate, a calcium salicylate, a calcium phenate, a sulfurized calcium phenate, a magnesium sulfonate, a magnesium carboxylate, a magnesium salicylate, a magnesium phenate, a sulfurized magnesium phenate, a potassium sulfonate, a potassium carboxylate, a potassium salicylate, a potassium phenate, a sulfurized potassium phenate, a zinc sulfonate, a zinc carboxylate, a zinc salicylate, a zinc phenate, and a sulfurized zinc phenate. Further examples include a calcium, lithium, sodium, potassium, and magnesium salt of a hydrolyzed phosphosulfurized olefin having about 10 to about 2,000 carbon atoms or of a hydrolyzed phosphosulfurized alcohol and/or an aliphatic-substituted phenolic compound having about 10 to about 2,000 carbon atoms. Even further examples include a calcium, lithium, sodium, potassium, and magnesium salt of an aliphatic carboxylic acid and an aliphatic substituted cycloaliphatic carboxylic acid and many other similar alkali and alkaline earth metal salts of oil-soluble organic acids. A mixture of a neutral or an overbased salt of two or more different alkali and/or alkaline earth metals can be used. Likewise, a neutral and/or an overbased salt of mixtures of two or more different acids can also be used.

As is well known, overbased metal detergents are generally regarded as containing overbasing quantities of inorganic bases, generally in the form of micro dispersions or colloidal suspensions. Thus the term "oil-soluble" as applied to metallic detergents is intended to include metal detergents wherein inorganic bases are present that are not necessarily completely or truly oil-soluble in the strict sense of the term, inasmuch as such detergents when mixed into base oils behave much the same way as if they were fully and totally dissolved in the oil. Collectively, the various metallic detergents referred to herein above, are sometimes called neutral, basic, or overbased alkali metal or alkaline earth metal-containing organic acid salts.

Methods for the production of oil-soluble neutral and overbased metallic detergents and alkaline earth metal-containing detergents are well known to those skilled in the art, and extensively reported in the patent literature. See, for example, U.S. Pat. Nos. 2,001,108; 2,081,075; 2,095,538; 2,144,078; 2,163,622; 2,270,183; 2,292,205; 2,335,017; 2,399,877; 2,416,281; 2,451,345; 2,451,346; 2,485,861; 2,501,731; 2,501,732; 2,585,520; 2,671,758; 2,616,904; 2,616,905; 2,616,906; 2,616,911; 2,616,924; 2,616,925; 2,617,049; 2,695,910; 3,178,368; 3,367,867; 3,496,105; 3,629,109; 3,865,737; 31907,691; 4,100,085; 4,129,589; 4,137,184; 4,184,740; 4,212,752; 4,617,135; 4,647,387; and 4,880,550.

The metallic detergents utilized in this invention can, if desired, be oil-soluble boronated neutral and/or overbased alkali of alkaline earth metal-containing detergents. Methods for preparing boronated metallic detergents are described in, for example, U.S. Pat. Nos. 3,480,548; 3,679,584; 3,829,381; 3,909,691; 4,965,003; and 4,965,004.

While any effective amount of the metallic detergents may be used, typically these effective amounts will range from about 0.01 to about 0.8 wt % in the finished fluid, for example from about 0.05 to about 0.6, and as a further example, from about 0.09 to about 0.4 wt % in the finished fluid.

Optionally, other components can be present in the lubricant composition. Non-limiting examples of other components include antiwear agents, dispersants, diluents, defoamers, demulsifiers, anti-foam agents, corrosion inhibitors, extreme pressure agents, seal well agents, antioxidants, pour point depressants, rust inhibitors and friction modifiers.

The lubricating compositions disclosed herein can be used to lubricate anything. In an aspect, the lubricating composition can be an engine oil composition that is used to lubricate an engine. However, one of ordinary skill in the art would understand that the disclosed lubricating compositions can be used to lubricate anything, e.g., any surface, such as those where thin-film friction can be present. Moreover, there is disclosed a method of reducing thin-film friction of a fluid between surfaces comprising providing to the fluid the disclosed composition.

It is further envisioned that the lubricating compositions can be provided to any machinery wherein fuel economy is an issue. In particular, there is disclosed a method of increasing fuel efficiency in a vehicle comprising providing to a vehicle the disclosed composition.

Also disclosed herein is a method of lubricating a machine, such as an engine, transmission, automotive gear, a gear set, and/or an axle with the disclosed lubricating composition. In a further aspect, there is disclosed a method of improving fuel efficiency in a machine, such as an engine, transmission, automotive gear, a gear set, and/or an axle comprising placing the disclosed lubricating composition in the machine, such as an engine, transmission, automotive gear, a gear set, and/or an axle.

EXAMPLES

Example 1

Base Oils

It is known in the industry that Group II base oils comprise more than 90% saturates, less than 0.03% sulfur, and have a viscosity index from about 80 to about 120. However, not all Group II base oils have the same thin-film frictional properties. The base oils in Table 1 were analyzed according to the procedure in Analytical Chemistry, 64:2227 (1992), the disclosure of which is hereby incorporated by reference, in order to determine the type of paraffins, cycloparaffns, and aromatics in the oil.

The thin-film friction coefficient of various known base oils (three Group II base oils and a PAO) was measured at 100° C./20N load with a 20% slide to roll ratio at 1.5 m/s.

TABLE 1

| Base Oils | Thin-Film Friction Coefficient | Kinematic Viscosity at 100° C. | % Tetracycloparaffins in Base Oil |
|---|---|---|---|
| A | 0.066 | 4.05 cSt | 3.33 |
| B | 0.044 | 4.60 cSt | 1.48 |
| C | 0.030 | 4.09 cSt | 1.57 |
| PAO | 0.027 | 4.00 cSt | 0.00 |

As shown in Table 1, base oil A and base oil C have similar kinematic viscosities, but A has a higher thin-film friction coefficient. Moreover, base oil B has a higher kinematic viscosity as compared to base oil A, but has a lower thin-film friction coefficient. The results for PAO show that in an oil with no tetracycloparaffins thin-film friction is low.

Moreover, as shown in Table 1, those base oils having less than about 3% tetracycloparaffins exhibited a lower thin-film friction as compared to other base oils. One of ordinary skill in the art would understand that the lower the thin-film friction the better the fuel economy.

Example 2

Base Oils and Detergents

Various detergents were mixed/blended/combined with each of base oil A and base oil C. The thin-film friction coefficients were measured as described in Example 1. The results are shown in Table 2.

TABLE 2

| | Base Oil A | Base Oil C |
|---|---|---|
| Calcium sulfonate (0.4%) | 0.071 | 0.045 |
| Calcium phenate (0.4%) | 0.074 | 0.069 |
| Calcium salicylate (0.4%) | 0.077 | 0.058 |

The results show that the thin-film friction coefficient was lower in all of the compositions having less than about 3% by weight of tetracycloparaffins in the base oil. The calcium sulfonate composition exhibited the lowest thin-film friction coefficient.

At numerous places throughout this specification, reference has been made to a number of U.S. patents, published foreign patent applications and published technical papers. All such cited documents are expressly incorporated in full into this disclosure as if fully set forth herein.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A lubricant composition comprising a detergent and a non-synthetic base oil comprising less than about 3%, and not 0%, by weight of tetracycloparaffins.

2. The composition of claim 1, wherein the detergent is a metal-based detergent.

3. The composition of claim 2, wherein the metal-based detergent comprises a detergent selected from one or more of a neutral sodium sulfonate, an overbased sodium sulfonate, a sodium carboxylate, a sodium salicylate, a sodium phenate, a sulfurized sodium phenate, a lithium sulfonate, a lithium carboxylate, a lithium salicylate, a lithium phenate, a sulfurized lithium phenate, a calcium sulfonate, a calcium carboxylate, a calcium salicylate, a calcium phenate, a sulfurized calcium phenate, a magnesium sulfonate, a magnesium carboxylate, a magnesium salicylate, a magnesium phenate, a sulfurized magnesium phenate, a potassium sulfonate, a potassium carboxylate, a potassium salicylate, a potassium phenate, a sulfurized potassium phenate, a zinc sulfonate, a zinc carboxylate, a zinc salicylate, a zinc phenate, and a sulfurized zinc phenate.

4. The composition of claim 2, wherein the metal-based detergent is chosen from a calcium sulfonate, a calcium carboxylate, a calcium salicylate, a calcium phenate, and a sulfurized calcium phenate.

5. The composition of claim 1, wherein the detergent is present in the lubricant composition in an amount ranging from 0.01 to about 0.8 wt. % relative to the total weight of the lubricant composition.

6. The composition of claim 1, wherein the detergent is present in the lubricant composition in an amount ranging from 0.05 to about 0.6 wt. % relative to the total weight of the lubricant composition.

7. The composition of claim 1, further comprising antiwear agents, dispersants, diluents, defoamers, demulsifiers, antifoam agents, corrosion inhibitors, extreme pressure agents, seal well agents, antioxidants, pour point depressants, rust inhibitors and friction modifiers.

8. A method of reducing thin-film friction of a fluid between surfaces comprising providing to the fluid a composition comprising a detergent and a non-synthetic base oil comprising less than about 3%, and not 0%, by weight of tetracycloparaffins.

9. A method of increasing fuel efficiency in a vehicle comprising providing to a vehicle a composition comprising a detergent and a non-synthetic base oil comprising less than about 3%, and not 0%, by weight of tetracycloparaffins.

10. The method of claim 9, wherein the detergent is a metal-based detergent.

11. The method of claim 10, wherein the metal-based detergent comprises a detergent selected from one or more of a neutral sodium sulfonate, an overbased sodium sulfonate, a sodium carboxylate, a sodium salicylate, a sodium phenate, a sulfurized sodium phenate, a lithium sulfonate, a lithium carboxylate, a lithium salicylate, a lithium phenate, a sulfurized lithium phenate, a calcium sulfonate, a calcium carboxylate, a calcium salicylate, a calcium phenate, a sulfurized calcium phenate, a magnesium sulfonate, a magnesium carboxylate, a magnesium salicylate, a magnesium phenate, a sulfurized magnesium phenate, a potassium sulfonate, a potassium carboxylate, a potassium salicylate, a potassium phenate, a sulfurized potassium phenate, a zinc sulfonate, a zinc carboxylate, a zinc salicylate, a zinc phenate, and a sulfurized zinc phenate.

12. The method of claim 10, wherein the metal-based detergent is chosen from a calcium sulfonate, a calcium carboxylate, a calcium salicylate, a calcium phenate, and a sulfurized calcium phenate.

13. An engine, transmission or gear set lubricated with a lubricant composition according to claim 1.

14. A method of making a lubricant composition comprising combining a detergent and a non-synthetic base oil comprising less than about 3%, and not 0%, by weight of tetracycloparaffins.

15. The method of claim 14, wherein the detergent is a metal-based detergent.

16. The method of claim 15, wherein the metal-based detergent comprises a detergent selected from one or more of a neutral sodium sulfonate, an overbased sodium sulfonate, a sodium carboxylate, a sodium salicylate, a sodium phenate, a sulfurized sodium phenate, a lithium sulfonate, a lithium carboxylate, a lithium salicylate, a lithium phenate, a sulfurized lithium phenate, a calcium sulfonate, a calcium carboxylate, a calcium salicylate, a calcium phenate, a sulfurized calcium phenate, a magnesium sulfonate, a magnesium carboxylate, a magnesium salicylate, a magnesium phenate, a sulfurized magnesium phenate, a potassium sulfonate, a potassium carboxylate, a potassium salicylate, a potassium phenate, a sulfurized potassium phenate, a zinc sulfonate, a zinc carboxylate, a zinc salicylate, a zinc phenate, and a sulfurized zinc phenate.

17. The method of claim 15, wherein the metal-based detergent is chosen from a calcium sulfonate, a calcium carboxylate, a calcium salicylate, a calcium phenate, and a sulfurized calcium phenate.

18. A method for lubricating a machine comprising providing to the machine the lubricant composition of claim 1.

19. The method of claim 18, wherein the machine is a gear.

20. The method of claim 18, wherein the machine is an engine.

* * * * *